US006472670B1

(12) United States Patent
Philipp et al.

(10) Patent No.: US 6,472,670 B1
(45) Date of Patent: Oct. 29, 2002

(54) METHOD FOR VERIFYING THE STATE OF A DEVICE USED TO EXAMINE SHEET ITEMS

(75) Inventors: Achim Philipp, Kolbermoor (DE); Heinz Hornung, Gilching (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 09/623,492

(22) PCT Filed: Jan. 17, 2000

(86) PCT No.: PCT/EP00/00315

§ 371 (c)(1),
(2), (4) Date: Nov. 3, 2000

(87) PCT Pub. No.: WO00/42578

PCT Pub. Date: Jul. 20, 2000

(30) Foreign Application Priority Data

Jan. 18, 1999 (DE) ..... 199 01 702

(51) Int. Cl.[7] ..... G07D 7/12
(52) U.S. Cl. ..... 250/372; 250/339.09
(58) Field of Search ..... 250/372, 339.09, 250/339.15, 342, 395; 374/129; 356/394

(56) References Cited

U.S. PATENT DOCUMENTS 3,755,674 A * 8/1973 Murray et al. ..... 250/395
4,560,874 A * 12/1985 Cinzori et al. ..... 250/339
5,578,828 A * 11/1996 Brown et al. ..... 250/342
5,812,270 A * 9/1998 Hampton et al. ..... 356/394

FOREIGN PATENT DOCUMENTS

| | | |
|---|---|---|
| DE | 2731531 A1 | 7/1977 |
| DE | 3145881 A1 | 11/1981 |
| DE | 3816943 A1 | 5/1988 |
| DE | 4022020 A1 | 7/1990 |
| GB | 2018984 | 10/1979 |
| GB | 2107911 | 5/1983 |
| GB | 2109923 | 6/1983 |
| WO | WO 98/26276 | 12/1977 |

* cited by examiner

*Primary Examiner*—Constantine Hannaher
*Assistant Examiner*—Otilia Gabor
(74) *Attorney, Agent, or Firm*—Bacon & Thomas, PLLC

(57) ABSTRACT

The invention relates to a method for checking the state of an apparatus for testing sheet material having at least one illumination device, transparent measuring window and detector. For ascertaining the soiling of a measuring window according to the invention the latter is irradiated with UV light by an illumination device, the UV light transmitted through the measuring window being filtered by a UV filter such that only a small fraction passes the filter and reaches a detector. Said fraction of UV light transmitted through the filter is detected and evaluated for determining the degree of soiling of the measuring window.

8 Claims, 1 Drawing Sheet

METHOD FOR VERIFYING THE STATE OF A DEVICE USED TO EXAMINE SHEET ITEMS

BACKGROUND OF THE INVENTION

This invention relates to a method for checking the state of an apparatus for testing sheet material having at least one illumination device, transparent measuring window and detector.

An apparatus of the abovementioned kind is known e.g. from WO 98/26276. Light emitted by an illumination device impinges on sheet material to be tested through a transparent measuring window. The light diffusely reflected by the sheet material is then detected and evaluated.

The known test apparatus for sheet material involves the problem that the measuring window can soil during operation. When the measuring window is soiled, less light from the irradiation device passes to the sheet material to be tested, for example, thereby reducing the measuring signal. During testing of the sheet material it cannot be ascertained whether the weaker measuring signal is to be attributed to a soiled measuring window or to the state of the sheet material to be tested. This means that soiling of the measuring window can result in misjudgment of the sheet material to be tested. This impairs the reliability of the sheet material testing.

SUMMARY OF THE INVENTION

The invention is based on the problem of proposing a method and apparatus for checking the state of a test apparatus for sheet material which makes it possible to ascertain with little technical effort the soiling impairing measurement in a measuring window of the test apparatus. The problem is solved according to the invention by the features stated in the independent claims.

For ascertaining the soiling in a measuring window according to the invention the latter is irradiated with UV light by an illumination device, the UV light transmitted through the measuring window being filtered by a UV filter such that only a small fraction passes the filter and reaches a detector. This fraction of UV light transmitted through the filter is detected and evaluated for determining the degree of soiling of the measuring window.

By reducing the transmitted light by using a filter after the light has passed through the measuring window, there is an improvement in determining the degree of soiling of the measuring window over the prior art. Therefore, the use of a filter has the advantage that the determination of the degree of soiling of the measuring window can be carried out more precisely.

Preferably, evaluation is effected such that an illumination profile is recorded and stored for a clean measuring window and compared with the particular illumination profile currently obtained from the detected signal. The degree of soiling of the measuring window can be determined with reference to the deviation of the currently recorded illumination profile from the stored illumination profile. Instead of illumination profiles, one can also compare the integrated measured values with each other. In both cases a deviation indicates soiling of the measuring window.

For determining the degree of soiling one preferably increases the sensitivity of the detector for example by prolonging the integration time or the light intensity of the illumination device or the signal gain compared to normal operation during testing of the sheet material. Further advantages and developments of the invention result from the dependent claims and the following description and examples of the invention with reference to the enclosed figures, in which:

DESCRIPTION OF THE INVENTION

Figure 1:
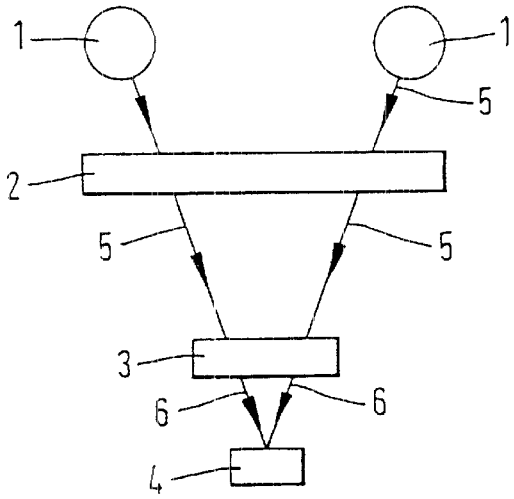
FIG. 1 shows the functional principle of checking the state of an apparatus for testing sheet material.

FIG. 1 shows by way of example a schematic representation of the functional principle for ascertaining the soiling in a measuring window. Measuring window 2 is irradiated with UV light 5 by an illumination device, e.g. by two UV lamps 1. UV light 5 transmitted through the measuring window is filtered by means of UV filter 3 such that only small fraction 6 of UV light 5 reaches detector 4. Only this fraction of UV light is detected and evaluated for determining the degree of soiling of the measuring window. The current measured value is thereby compared with a stored reference value obtained for a clean measuring window. Comparison can be effected using the integrated measured values or using the recorded illumination profiles in certain cycles which depend on the operating time. Since evaluation is based only on UV light fraction 6 passing filter 3 and said fraction is small compared to UV light 5 emitted by the illumination device, which is only a few percent for example, one preferably increases the sensitivity of the detector for example by prolonging the integration time or the light intensity of the illumination device or the signal gain for checking the state of the measuring window compared to operation during testing of the sheet material, thereby facilitating and improving the evaluation.

Figure 2:
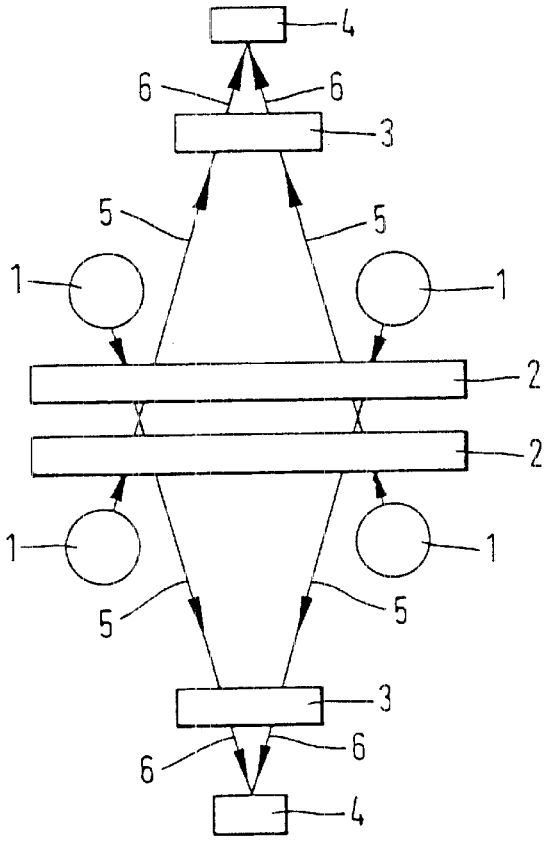
FIG. 2 shows an example of an apparatus with detectors on both sides.

FIG. 2 shows an apparatus for checking sheet material, in particular bank notes, provided for example with two measuring windows 2 disposed a distance apart. Each measuring window has illumination device 1 associated therewith, e.g. in the form of two UV lamps 1. The bank note transported between measuring windows 2 and not shown here is e.g. excited on both sides with UV light during authenticity testing, the light diffusely reflected by the bank note on each side being detected by detectors 4. For example, bank notes when excited by UV light emit light in the visible wave range, which constitutes a criterion for the authenticity of the bank notes among other things. Each detector 4 is preceded by UV filter 3, but this does not impair the measuring signal of the bank note since filters 3 pass light diffusely reflected by the bank note in the visible wave range. One preferably checks the state of the measuring windows by irradiating measuring windows 2 on each side by means of UV light 5 emitted by illumination devices 1. UV light 5 transmitted through measuring windows 2 is filtered by filters 3 such that only small fraction 6, which is a few percent for example, passes to detectors 4. Fraction 6 of UV light 5 transmitted through filters 3 is detected and evaluated for determining the degree of soiling of the measuring windows. For checking the state of measuring windows 2 one can also irradiate the latter with UV light from only one side, as described above in connection with FIG. 1.

What is claimed is:

1. A method for determining the degree of soiling of a transparent measuring window of an apparatus for testing a sheet material, said apparatus including at least one illumination device, a UV filter and a detector, said method comprising the following steps of:

irradiating the measuring window with UV light;

filtering the UV light transmitted by the measuring window with said UV filter such that only a small fraction of UV light is passed therethrough towards the detector;

measuring the amount of UV light transmitted by the UV filter to produce a measured value; and comparing the measured value with a stored reference value.

2. The method according to claim 1 wherein said measured value is an illumination profile of said measuring window and said reference value is an illumination profile of a clean measuring window.

3. The method according to claims 1 wherein said measured value is integrated and said stored reference value is integrated and obtained from a clean measuring window.

4. The method according to claim 2 wherein the measured value and the stored value are cyclically compared.

5. The method according to claim 1 wherein the sensitivity of the detector, the light intensity of the illumination device or a signal gain is increased for determining the degree of soiling of the measuring window in comparison with operation for testing the sheet material.

6. An apparatus for carrying out the method according to claim 1 comprising a first illumination device, a first measuring window, a first filter and a first detector;

wherein the first illumination device is positioned on one side of the first measuring window such that UV light emitted by the first illumination device passes through the first measuring window towards said first filter positioned on another side of said first measuring window;

wherein said first filter passes only a small fraction of UV light towards the first detector, so that the fraction of UV light transmitted through the first filter may be detected by the detector and evaluated for determining the degree of soiling of the first measuring window.

7. The apparatus according to claim 6 wherein a second measuring window is positioned at a predetermined distance from said first measuring window such that UV light emitted by the first illumination device passes through the first and second measuring windows towards the first filter, said first filter passing only a small fraction of UV light towards the first detector, so that the fraction of UV light transmitted through the first filter may be detected by the first detector and evaluated for determining the degree of soiling of the first and second measuring windows.

8. The apparatus according to claim 7 further comprising a second illumination device, a second filter and a second detector, wherein said second illumination device is positioned on said another side of the first measuring window such that UV light emitted by the second illumination device passes through the second and first measuring windows towards the second filter;

wherein said second filter passes only a small fraction of UV light towards the second detector, so that the fraction of UV light transmitted through the second filter may be detected by the second detector and evaluated, for determining the degree of soiling of the first and second measuring windows.

* * * * *